US012487023B2

(12) United States Patent
Zha et al.

(10) Patent No.: US 12,487,023 B2
(45) Date of Patent: Dec. 2, 2025

(54) REFRIGERATION SYSTEM AND METHOD OF DEFROSTING THE SAME

(71) Applicant: Heatcraft Refrigeration Products LLC, Stone Mountain, GA (US)

(72) Inventors: Shitong Zha, Snellville, GA (US); Douglas S. Cole, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 120 days.

(21) Appl. No.: 18/358,287

(22) Filed: Jul. 25, 2023

(65) Prior Publication Data

US 2025/0035366 A1 Jan. 30, 2025

(51) Int. Cl.
*F25D 21/00* (2006.01)
*F25D 21/06* (2006.01)

(52) U.S. Cl.
CPC ..... *F25D 21/06* (2013.01); *F25D 21/004* (2013.01)

(58) Field of Classification Search
CPC ..... F25D 21/06; F25D 21/004; F25B 1/10; F25B 47/02; F25B 47/022; F25B 2313/02322; F25B 2313/02332; F25B 2313/02342; F25B 2347/02; F25B 2347/021; F25B 2347/022; F25B 41/20; F25B 41/22; F25B 41/31; F25B 41/385; F25B 2600/25; F25B 2600/2501; F25B 2600/2507; F25B 2600/2519
See application file for complete search history.

(56) References Cited

U.S. PATENT DOCUMENTS

2021/0003331 A1* 1/2021 Hollister ..... F25B 1/10
2023/0071132 A1* 3/2023 Sakthivel ..... F25B 41/22

* cited by examiner

*Primary Examiner* — Miguel A Diaz

(57) ABSTRACT

The disclosure provides a method of operating a refrigeration system. The method includes operating a first low-temperature evaporator in a refrigeration mode, where the first low-temperature evaporator receives refrigerant from a flash tank. The method includes operating a second low-temperature evaporator in a refrigeration mode, where the first low-temperature evaporator receives refrigerant from the flash tank. The method includes causing the first low-temperature evaporator to operate in the defrost mode by: closing a first controllable valve in a refrigerant conduit that couples the first low-temperature evaporator to a low-temperature compressor of the refrigeration system, and directing the refrigerant exiting the first low-temperature evaporator to be received by the second low-temperature evaporator.

17 Claims, 5 Drawing Sheets

REFRIGERATION SYSTEM AND METHOD OF DEFROSTING THE SAME

TECHNICAL FIELD

This disclosure relates generally to refrigeration systems. More particularly, in certain embodiments, this disclosure relates to a refrigeration system and a method of defrosting the same.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY

During operation of refrigeration systems, ice may build up on evaporators. It is advantageous for these evaporators to be defrosted to remove ice buildup and mitigate loss of performance in the system. Previous evaporator defrost processes are limited in terms of their efficiency and effectiveness. For example, electric heaters have been used to heat the evaporators during defrosting. However, certain refrigeration systems do not have adequate space to incorporate electric heaters into the system for defrosting. Further, electric heaters can consume a large amount of energy. Other defrost technology includes using hot gas from a compressor to defrost the evaporator. However, in certain systems, hot gas from the compressor does not have enough flow to sufficiently defrost the evaporators in a defrost mode.

This disclosure provides technical solutions to the problems of previous technology, including those described above. Embodiments of the present disclosure provide a refrigeration system that facilitates improved evaporator defrost using liquid refrigerant from the flash tank to defrost a low-temperature evaporator in the refrigeration system. For example, certain embodiments provide a refrigeration system comprising a first low-temperature evaporator and a second low-temperature evaporator located downstream of a flash tank. When operating in a defrost mode, liquid refrigerant from the flash tank may be used to flood and defrost the first low-temperature evaporator, and the liquid refrigerant exiting the first low-temperature evaporator may be used as a feed refrigerant for the second low-temperature evaporator operating in a refrigeration mode to cool a space. In some embodiments, the second low-temperature evaporator may receive liquid refrigerant from the flash tank to defrost, and the first low-temperature evaporator may receive the liquid refrigerant exiting the second low-temperature evaporator as feed refrigerant while operating in a refrigeration mode to cool a space proximate the first low-temperature evaporator. In some embodiments, the refrigerant from the flash tank may be delivered to either the first low-temperature evaporator or the second low-temperature evaporator as predominately a liquid refrigerant by opening an expansion valve upstream of the respective low-temperature evaporator to a sufficient degree such that a predominate fraction of the refrigerant exists as a liquid refrigerant. In some embodiments, the refrigerant from the flash tank may be delivered to either the first low-temperature evaporator or the second low-temperature evaporator as predominately a liquid refrigerant via by-passing the expansion valve with a by-pass conduit and a by-pass valve. Embodiments of this disclosure may provide improved defrost operations for evaporators of refrigeration systems, such as $CO_2$ refrigeration systems.

In an embodiment, a refrigeration system includes a flash tank configured to receive refrigerant from a gas cooler through a refrigerant conduit. The flash tank is configured to store at least a portion of the refrigerant received from the gas cooler. The refrigeration system includes a first low-temperature evaporator located downstream of the flash tank that is configured to receive the refrigerant from the flash tank through the refrigerant conduit, and a second low-temperature evaporator located downstream of the flash tank that is configured to receive the refrigerant from the flash tank. The system includes a low-temperature compressor located downstream of the first low-temperature evaporator and the second low-temperature evaporator. The low-temperature compressor is configured to receive refrigerant from the first low-temperature evaporator and the second low-temperature evaporator through the refrigerant conduit. The refrigeration system includes a controllable valve positioned in the refrigerant conduit and downstream from the first low-temperature evaporator. The first controllable valve is configured to receive refrigerant from the first low-temperature evaporator and direct a flow of the received refrigerant to: (i) the low-temperature compressor when the first controllable valve is configured in an open position; and (ii) the second low-temperature evaporator when the controllable valve is configured in a closed position. The refrigeration system includes a controller communicatively coupled to the controllable valve, where the controller is configured to cause the first low-temperature evaporator to operate in the defrost mode by closing the first controllable valve to direct the refrigerant exiting the first low-temperature evaporator to be received by the second low-temperature evaporator.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1-6 of the drawings, like numerals being used for like and corresponding parts of the various drawings.

As described above, certain defrost operations of refrigeration systems suffered from inefficiencies and drawbacks. The refrigeration system of the present disclosure provides improved defrost performance and energy efficiency. Embodiments of the present disclosure provide a refrigeration system that facilitates improved evaporator defrost by using liquid refrigerant from the flash tank to defrost a low-temperature evaporator in the refrigeration system. For example, certain embodiments provide a refrigeration system comprising a first low-temperature evaporator and a second low-temperature evaporator located downstream of a flash tank. When operating in a defrost mode, liquid refrigerant from the flash tank may be used to flood and defrost the first low-temperature, and the liquid refrigerant exiting the first low-temperature evaporator may be used as a feed refrigerant for the second low-temperature evaporator operating in a refrigeration mode to cool a space proximate the second low-temperature evaporator. In some embodiments, the second low-temperature evaporator may receive liquid refrigerant from the flash tank to defrost, and the first low-temperature evaporator may receive the liquid refrigerant exiting the second low-temperature evaporator as feed refrigerant while operating in a refrigeration mode to cool a space proximate the first low-temperature evaporator. In some embodiments, the refrigerant from the flash tank may be delivered to either the first low-temperature evaporator or the second low-temperature evaporator as predominately a liquid refrigerant by opening an expansion valve upstream of the respective low-temperature evaporator to a sufficient degree such that a predominate fraction or all of the refrigerant exists as a liquid refrigerant prior to entering the respective low-temperature evaporator. In some embodiments, the refrigerant from the flash tank may be delivered to either the first low-temperature evaporator or the second low-temperature evaporator as predominately, or entirely, a liquid refrigerant via by-passing the expansion valve with a by-pass conduit and a by-pass valve. Embodiments of this disclosure may provide improved defrost operations for evaporators of refrigeration systems, such as $CO_2$ refrigeration systems.

Refrigeration System

Figure 1:
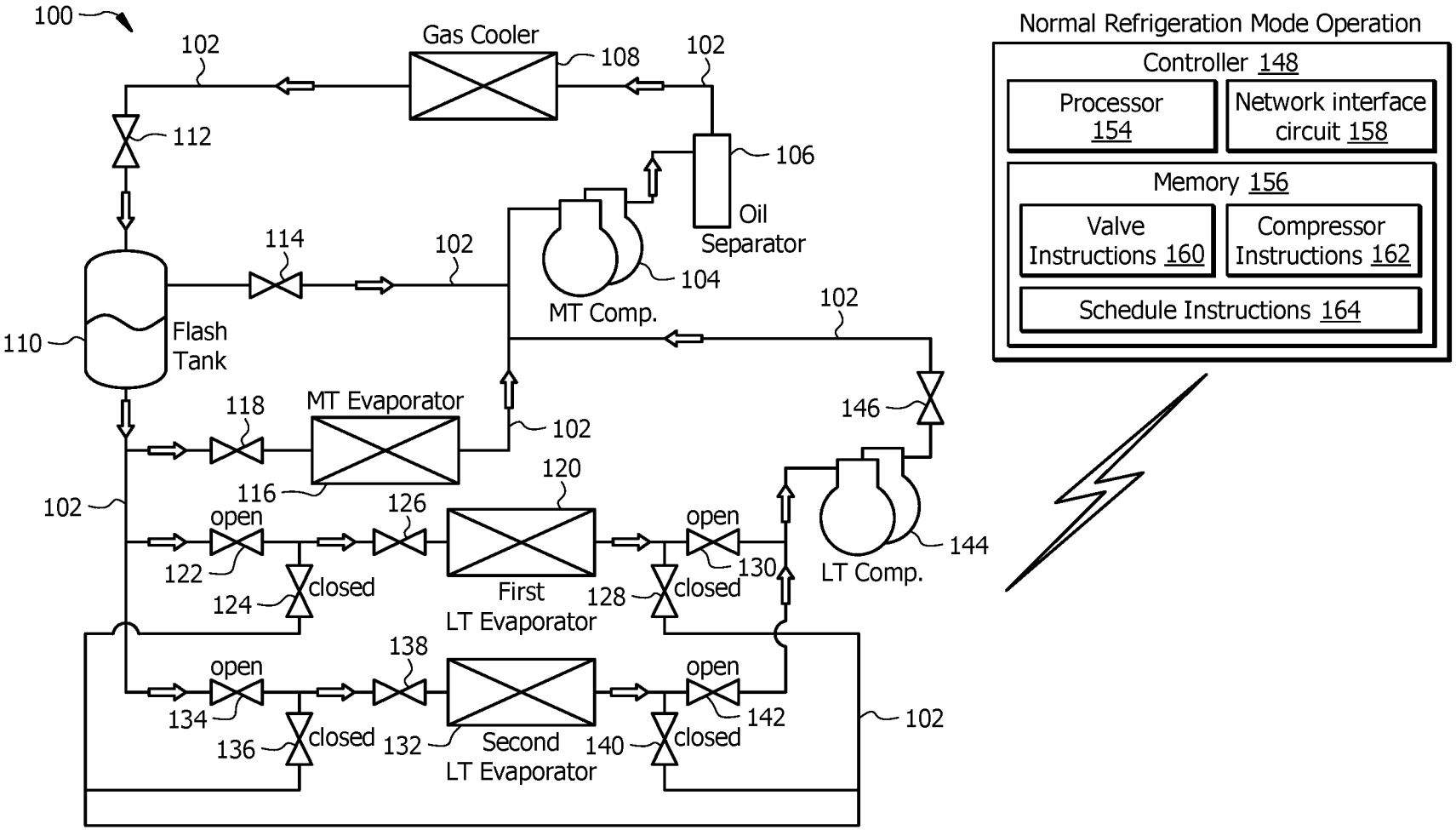
FIG. 1 is a diagram of an example refrigeration system configured to operate evaporators in a refrigeration mode.
Figure 2:
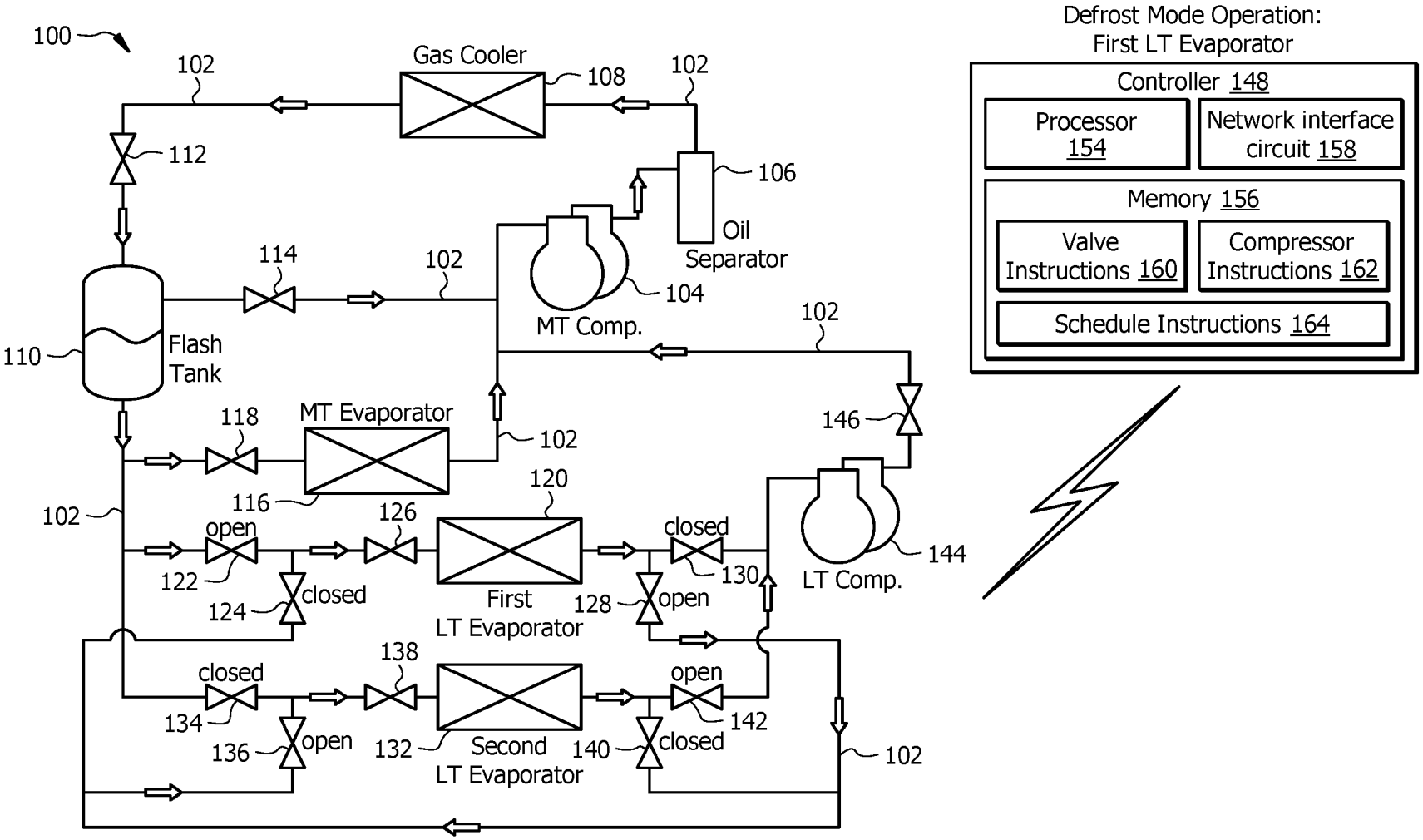
FIG. 2 is a diagram of the example refrigeration system of FIG. 1 configured to operate a first low-temperature evaporator in a defrost mode.
Figure 3:
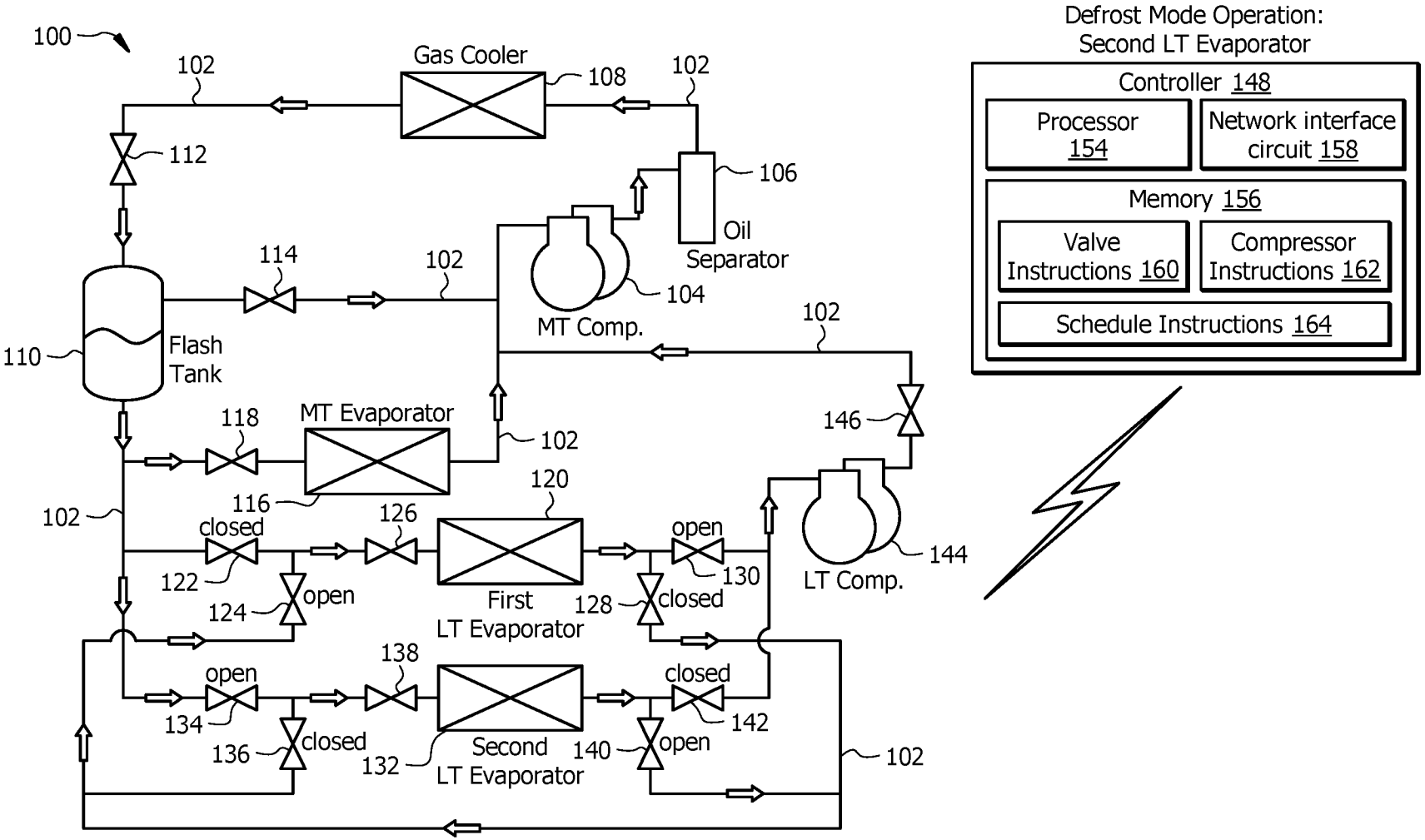
FIG. 3 is a diagram of the example refrigeration system of FIG. 1 configured to operate a second low-temperature evaporator in a defrost mode.
Figure 4:
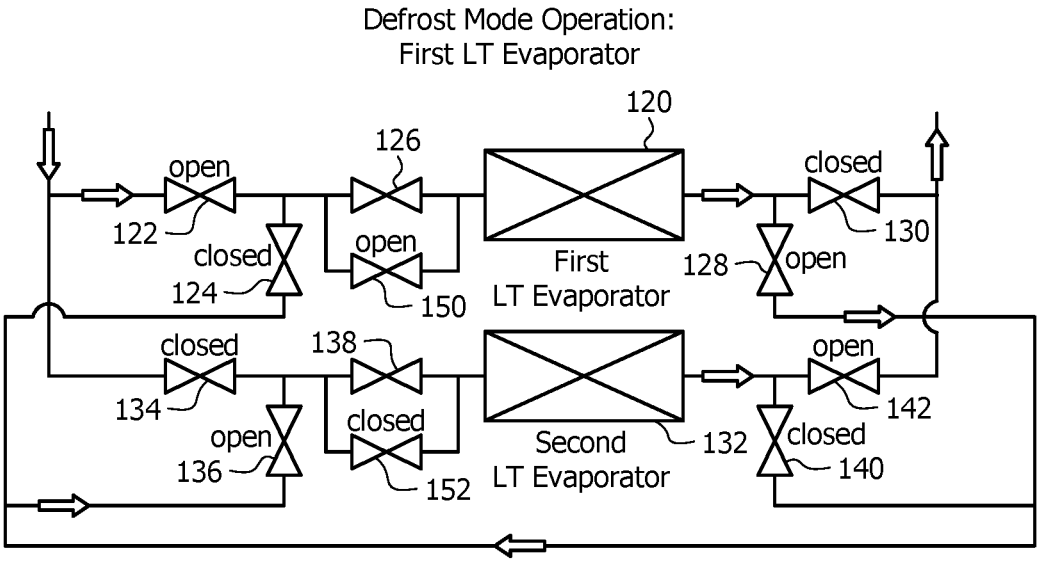
FIG. 4 is a diagram of an alternative example refrigeration system of FIG. 1 configured to operate the first low-temperature evaporator in a defrost mode.
Figure 5:
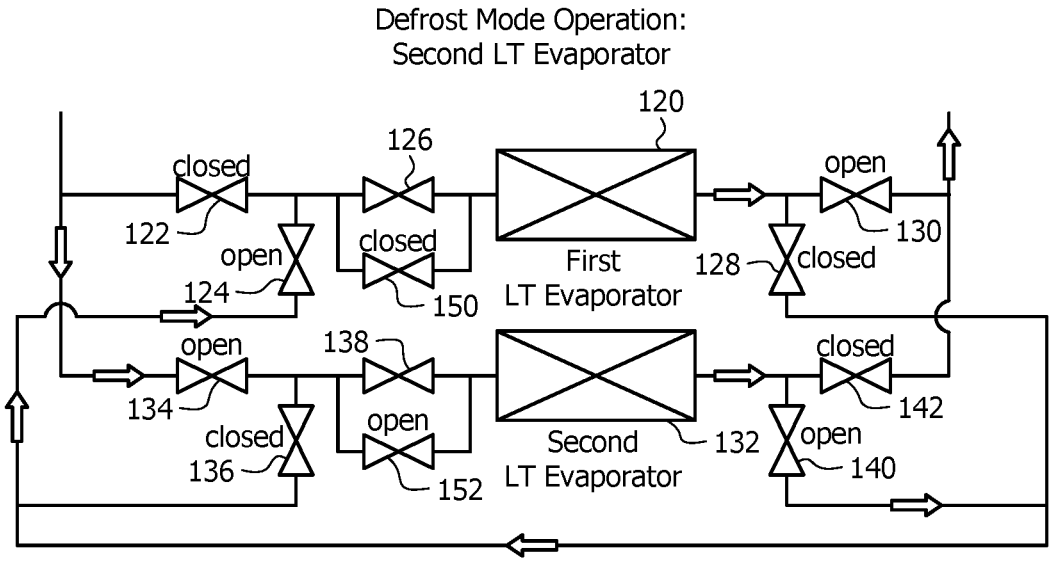
FIG. 5 is a diagram of an alternative example refrigeration system of FIG. 1 configured to operate the second low-temperature evaporator in a defrost mode.

FIGS. 1 to 5 illustrate an example refrigeration system 100 according to various embodiments of the present disclosure. The refrigeration system 100 shown in FIG. 1 is configured to operate a first low-temperature (LT) evaporator 120 and a second low-temperature evaporator 132 in a refrigeration mode. FIGS. 2 and 4 illustrate example embodiments for when the refrigeration system 100 is configured for operation of the first low-temperature evaporator 120 in a defrost mode, and FIGS. 3 and 5 illustrate example embodiments for when the refrigeration system 100 is configured for operation of the second low-temperature evaporator 132 in a defrost mode.

The refrigeration system 100 includes a refrigerant conduit 102, one or more medium-temperature (MT) compressor 104, an oil separator 106, a gas cooler 108, flash tank 110 and corresponding valves 112, 114, a MT evaporator 116 and corresponding valve 118, a first LT evaporator 120 and corresponding valves 122, 124, 126, 128, 130, a second LT evaporator 132 and corresponding valves 134, 136, 138, 140, 142, a second LT compressor 144 and corresponding valve 146, and a controller 148. In some embodiments, the refrigeration system 100 is a transcritical refrigeration system that circulates a transcritical refrigerant such as $CO_2$.

The refrigerant conduit 102 facilitates the movement of refrigerant (e.g., $CO_2$) through the refrigeration system 100. The refrigerant flows through the refrigerant conduit 102 as indicated by the arrows in FIGS. 1-5. The refrigerant conduit 102 includes conduit, tubing, and the like that facilitates the movement of refrigerant between components of the refrigeration system 100.

The MT compressor(s) 104 are configured to compress refrigerant discharged from the MT evaporator(s) 116 that are operating in refrigeration mode and provide supplemental compression to refrigerant discharged from the LT compressor 144. Refrigeration system 100 may include any suitable number of MT compressors 104. MT compressor(s) 104 may vary by design and/or by capacity. For example, some compressor designs may be more energy efficient than other compressor designs, and some MT compressors 104 may have modular capacity (e.g., a capability to vary capacity). The controller 148 is in communication with the MT compressor(s) 104 and controls their operation.

The oil separator 106 may be located downstream of the MT compressor(s) 104. The oil separator 106 is operable to separate compressor oil from the refrigerant. The refrigerant is provided to the gas cooler 108, while the oil may be collected and returned to the MT compressor(s) 104, as appropriate.

Gas cooler 108 is generally operable to receive refrigerant (e.g., from MT compressor(s) 104) and apply a cooling stage to the received refrigerant. In some embodiments, gas cooler 108 is a heat exchanger comprising cooler tubes configured to circulate the received refrigerant and coils through which ambient air is forced. Inside gas cooler 108, the coils may absorb heat from the refrigerant, thereby cooling the refrigerant.

Flash tank 110 is configured to receive refrigerant from the gas cooler 108 through the refrigerant conduit 102. The flash tank 110 is configured to separate the received refrigerant into flash gas and liquid refrigerant. Flash tank 110 may include one or more tanks operable to hold refrigerant at least temporarily. Typically, the flash gas collects near the top of flash tank 110, and the liquid refrigerant is collected in the bottom of flash tank 110. The liquid refrigerant is configured to flow from the flash tank 110 to the MT evaporator 116, the first LT evaporator 120, and the second LT evaporator 132 via the refrigerant conduit 102. Flash gas refrigerant is configured to flow from the flash tank 110 to the MT compressor 104 via the refrigerant conduit 102.

A flash tank inlet valve 112 may be disposed at or near an inlet of the flash tank 110 to reduce pressure of refrigerant received by the flash tank 110. The flash tank inlet valve 112 may be positioned in refrigerant conduit 102 and located in a portion of the refrigerant conduit 102 that connects the gas cooler 108 to the flash tank 110. The flash tank inlet valve 112 is configured to open and close to permit or restrict the flow of refrigerant from the gas cooler 108 to the flash tank 110. A flash gas by-pass valve 114 may be positioned in the refrigerant conduit 102 and located in a portion of the refrigerant conduit 102 that connects the flash tank 110 to the MT compressor(s) 104. The flash gas by-pass valve is configured to open and close to permit or restrict the flow of flash gas discharged from flash tank 110. The controller 148 is in communication with the flash tank inlet valve 112 and the flash gas by-pass valve 114 and controls their operation.

The MT evaporator 116 is located down stream of the flash tank 110 and is configured to receive liquid refrigerant from the flash tank 110 through the refrigerant conduit 102. The MT evaporator 116. The MT evaporator 116 is configured to use the refrigerant to provide cooling to a target MT space proximate the MT evaporator 116. As an example, the MT evaporator 116 may be part of a refrigerated case and/or cooler for storing items that should be kept at particular temperatures. The refrigeration system 100 may include any appropriate number of MT evaporators 116 with the same or a similar configuration to that shown for the example MT evaporator 116 shown in FIGS. 1-5. The MT evaporator 116 may include a MT expansion valve 118 that is positioned in the refrigerant conduit 102 and located in a portion of the refrigerant conduit 102 between the flash tank 110 and the MT evaporator 116. The MT expansion valve 118 may be configured to receive liquid refrigerant from the flash tank 110 and reduce the pressure of the received refrigerant. In some embodiments, the reduction in pressure causes a portion of the refrigerant to vaporize. The MT expansion valve 118 may be any motorized or electronically controllable valve, such as motorized ball valves, solenoid valves, and/or the like. The controller 148 is in communication with the MT expansion valve 118 and controls its operation.

When the MT evaporator 116 is operated in a refrigeration mode as illustrated in FIG. 1, the MT expansion valve 118 receives liquid refrigerant from the flash tank 110 and reduces the pressure of the refrigerant before it reaches the MT evaporator 116. The MT expansion valve 118 may be configured to achieve a refrigerant temperature into the MT evaporator 116 at a predefined temperature for a given application (e.g., about −6° C.). Refrigerant exiting the MT evaporator 116 is returned to the MT compressor 104 through the refrigerant conduit 102.

The first LT evaporator 120 and the second LT evaporator 132 are generally similar to the MT evaporator 116 but are configured to operate at lower temperatures (e.g., for deep freezing applications near about −30° C. or the like). The first LT evaporator 120 and the second LT evaporator 132 are located downstream of the flash tank 110 and are configured to receive refrigerant from the flash tank 110 through the refrigerant conduit 102. When operated in a refrigeration mode (see FIG. 1), the first LT evaporator 120 and the second LT evaporator 132 receive refrigerant from the flash tank 110 and are configured to use the cooled refrigerant to provide cooling to a target LT space. As an example, the first LT evaporator 120 and the second LT evaporator 132 may be part of a deep freezer for relatively long-term storage of perishable items that should be kept at particular temperatures. For clarity and conciseness, the components for a first LT evaporator 120 and a second LT evaporator 132 are illustrated, however any appropriate number of LT evaporators may be used with similar components described herein.

The LT compressor(s) 144 are configured to compress refrigerant discharged from the first LT evaporator 120 and the second LT evaporator 132. Refrigeration system 100 may include any suitable number of LT compressors 144. LT compressor(s) 144 may vary by design and/or by capacity. For example, some compressor designs may be more energy efficient than other compressor designs, and some LT compressors 144 may have modular capacity (e.g., a capability to vary capacity). The controller 148 is in communication with the LT compressors 144 and controls their operation. The MT compressor(s) 104 is configured to receive the refrigerant exiting the LT compressor(s) 144 and provide supplemental compression to the refrigerant discharged from the LT compressor(s) 144. A valve 146 may be positioned in the refrigerant conduit 102 located between the LT compressor(s) 144 and the MT compressor(s) 104. The valve 146 is configured to adjust the pressure of the refrigerant exiting the LT compressor(s) 144. The controller 148 is in communication with the valve 146 and controls its operation.

The first LT evaporator 120 includes a first LT expansion valve 126 positioned in the refrigerant conduit 102 and located between the flash tank 110 and the first LT evaporator 120. Similarly, the second LT evaporator 132 includes a second LT expansion valve 138 positioned in the refrigerant conduit 102 and located between the flash tank 110 and the second LT evaporator 132. The first LT expansion valve 126 and the second LT expansion valve 138 may be configured to receive liquid refrigerant from the flash tank 110 and reduce the pressure of the received refrigerant. In some embodiments, the reduction in pressure causes a portion of the refrigerant to vaporize. In some embodiments, the first LT expansion valve 126 and the second LT expansion valve 138 may be configured to achieve a predefined refrigerant temperature into the first LT evaporator 120 and the second LT evaporator 132, respectively, for a given application (e.g., about −30° C.). The predefined temperature may be controlled by the reduction of pressure induced by the respective expansion valve. The first LT expansion valve 126 and the second LT expansion valve 138 may be any motorized or electronically controllable valve, such as motorized ball valves, solenoid valves, and/or the like. The controller 148 is in communication with the first LT expansion valve 126 and the second LT expansion valve 138 and controls their operation.

Referring to FIGS. 3-4 momentarily, in some embodiments, the refrigeration system 100 includes a first by-pass valve 150 positioned in the refrigerant conduit 102 and located between the flash tank 110 and the first LT evaporator 120. When the first by-pass valve 150 is in a closed position the refrigerant flows from the flash tank 110 to the LT evaporator 120 through the first LT expansion valve. When the first by-pass valve is in an open position the refrigerant flows from the flash tank 110 to the first LT evaporator through the first by-pass valve 150. In some embodiments, the refrigeration system 100 includes a second by-pass valve 152 positioned in the refrigerant conduit 102 and located between the flash tank 110 and the second LT evaporator 132. When the second by-pass valve 152 is in a closed position the refrigerant flows from the flash tank 110 to the second LT evaporator 132 through the first LT expansion valve 138. When the second by-pass valve 152 is in an open position the refrigerant flows from the flash tank 110 to the second LT evaporator 132 through the second by-pass valve 152.

The first LT evaporator 120 includes valves 122, 124, 128, 130 that are configured to facilitate operation of the first LT evaporator 120 in a refrigeration mode (see FIG. 1) and a defrost mode (see FIGS. 2 and 4). Similarly, the second LT evaporator 132 includes valves 134, 136, 138, 140, 142 that are configured to facilitate operation of the second LT evaporator 132 in a refrigeration mode (see FIG. 1) and a defrost mode (see FIGS. 3 and 5). The valves 122, 124, 128, 130 of the first LT evaporator 120 and the valves 134, 136, 140, 142 of the second LT evaporator 132 may be any motorized or electronically controllable valve, such as motorized ball valves, solenoid valves, and/or the like. The controller 148 may be in communication with the valves 122, 124, 128, 130 of the first LT evaporator 120 and the valves 134, 136, 140, 142 of the second LT evaporator 132 and controls its operation. In some embodiments, valves 124, 128 of the first LT evaporator 120 and valves 136, 140 of the second evaporator 132 may be check valves, as will be described in more detail below.

In some embodiments, the valve 130 is a first controllable valve positioned in the refrigerant conduit and downstream of the LT evaporator 120. The first controllable valve 130 is configured to receive refrigerant from the first LT evaporator 120 and direct a flow of the received refrigerant to: (i) the LT compressor(s) 144 when the first controllable valve 130 is configured in an open position, and (ii) the second LT evaporator 132 when the first controllable valve 130 is configured in a closed position.

In some embodiments, the valve 122 is a second controllable valve positioned in the refrigerant conduit 102 and located between the flash tank 110 and the first LT evaporator 120. When the second controllable valve 122 is in an open position the refrigerant from the flash tank 110 flows to the first LT evaporator 120 through the second controllable valve 122. When the second controllable valve 122 is in a closed position the refrigerant from the flash tank 110 is restricted from flowing to the first LT evaporator 120 and is directed toward the second LT evaporator 132 via the refrigerant conduit 102.

In some embodiments, the valve 134 is a third controllable valve positioned in the refrigerant conduit 102 and located between the flash tank 110 and the second LT evaporator 132. When the third controllable valve 134 is in an open position the refrigerant from the flash tank 110 flows to the second LT evaporator 132 through the third controllable valve 122. When the third controllable valve 134 is in a closed position the refrigerant from the flash tank 110 is restricted from flowing to the second LT evaporator 132 and is directed toward the first LT evaporator 120 via the refrigerant conduit 102.

In some embodiments, the valve 142 is a fourth controllable valve positioned in the refrigerant conduit 102 and located downstream from the second LT evaporator 132. The fourth controllable valve 142 is configured to receive refrigerant from the second LT evaporator 132 and direct the flow of refrigerant to: (i) the LT compressor(s) 144 when the fourth controllable valve 142 is configured in an open position, and (ii) the first low-temperature evaporator when the fourth controllable valve is configured in a closed position.

In some embodiments, the valve 128 is a first check valve positioned in a portion of the refrigerant conduit 102 that directs the refrigerant exiting the first LT evaporator 120 to mix with refrigerant entering the second LT evaporator 132. The first check valve 128 is configured to allow flow of refrigerant exiting the first LT evaporator 120 to mix with the refrigerant entering the second LT evaporator 132 through the refrigerant conduit 102 when a pressure difference across the first check valve 128 exceeds a threshold pressure (e.g., 1 to 5 psi). In other words, the first check valve 128 is a one-way valve that restricts the refrigerant exiting the first LT evaporator 120 from mixing with the refrigerant entering the second LT evaporator 132 when the pressure is below the threshold pressure, and allows flow to the second LT evaporator 132 if the threshold pressure is exceeded. The threshold pressure is exceeded when the first controllable valve 130 is closed, in which case the refrigerant exiting the first LT evaporator 120 passes through check valve 128 and mixes with the refrigerant entering the second LT evaporator 132. Alternatively, the valve 128 may be a controllable valve in communication with the controller 148 which controls its operation.

In some embodiments, the valve 140 is a second check valve positioned in a portion of the refrigerant conduit that directs the refrigerant exiting the second LT evaporator 132 to mix with the refrigerant entering the first LT evaporator 120. The second check valve 128 is configured to allow the flow of refrigerant exiting the second LT evaporator 132 to mix with the refrigerant entering the first LT evaporator 120 through refrigerant conduit 102 when a pressure difference across the check valve 140 exceeds a threshold pressure (e.g., 1 to 5 psi). The second check valve 140 may be a one-way valve that restricts the refrigerant exiting the second LT evaporator 132 from mixing with the refrigerant entering the first LT evaporator 120 when the pressure is below the threshold pressure, and allows the flow to the first LT evaporator 120 if the threshold pressure is exceeded. The threshold pressure is exceeded when the fourth controllable valve 142 is closed, in which case the refrigerant exiting the second LT evaporator 132 passes through the second check valve 140 and mixes with the refrigerant entering the first LT evaporator 120. Alternatively, the valve 140 may be a controllable valve in communication with the controller 148 which controls its operation.

In some embodiments, valve 136 is a third check valve positioned in the refrigerant conduit 102 and located downstream of the first check valve 128. The third check valve 136 is configured to allow the flow of refrigerant exiting the first LT evaporator 120 to mix with the refrigerant entering the second LT evaporator 132 through the refrigerant conduit 102 when a pressure difference across the third check valve 136 exceeds a threshold pressure (e.g., 1 to 5 psi). In some embodiments, the refrigerant that passes through the check valve 136 is mixed with the refrigerant between the third controllable valve 134 and the second LT expansion valve 138. The third check valve 136 is a one-way valve that allows flow from the first LT evaporator 120 when the first controllable valve 130 is closed and the third controllable valve 134 is closed. Closing the first controllable valve 130 causes the refrigerant exiting the first LT evaporator 120 to pass through the first check valve 128 and closing the third controllable valve 134 creates a pressure differential that exceeds the threshold pressure of the third check valve 136 to allow the refrigerant to flow from the first LT evaporator 120 to the second LT evaporator 132. When the third controllable vale 134 is open the third check valve 136 is closed and restricts the flow of the refrigerant from flowing from the first LT evaporator 120 to the second LT evaporator 132. Alternatively, the valve 136 may be a controllable valve in communication with the controller 148 which controls its operation.

In some embodiments, valve 124 is a fourth check valve positioned in the refrigerant conduit 102 and located downstream of the second check valve 140. The fourth check valve 124 is configured to allow the flow of refrigerant exiting the second LT evaporator 132 to mix with the refrigerant entering the first LT evaporator 120 through the refrigerant conduit 102 when a pressure difference across the fourth check valve 124 exceeds a threshold pressure (e.g., 1 to 5 psi). In some embodiments, the refrigerant that passes through the fourth check valve 124 is mixed with the refrigerant between the second controllable valve 122 and the first LT expansion valve 126. The fourth check valve 124 is a one-way valve that allows flow of refrigerant from the second LT evaporator 132 when the fourth controllable valve 142 is closed and the second controllable valve 122 is closed. Closing the fourth controllable valve 142 causes the refrigerant exiting the second LT evaporator 132 to pass through the second check valve 140 and closing the second controllable valve 122 creates a pressure differential that exceeds the threshold pressure of the fourth check valve 124 to allow the refrigerant to flow from the second LT evaporator 132 to the first LT evaporator 120 through the fourth check valve 124. When the second controllable vale 122 is open the fourth check valve 124 is closed and restricts the flow of the refrigerant from flowing from the second LT evaporator 132 to the first LT evaporator 120. Alternatively, the valve 124 may be a controllable valve in communication with the controller 148 which controls its operation.

The controller 148 is in communication with valves 112, 114 of the flash tank 110, valve 118 of the MT evaporator, the MT compressor(s) 104, valves 122, 124, 126, 128, 130, 150 of the first LT evaporator 120, valves 134, 136, 138, 140, 142, 152 of the second LT evaporator 132, the LT compressor(s) 144, and valve 146 of the LT compressor(s) 144. The controller 148 adjusts operation of components of the refrigeration system 100 to operate the first LT evaporator 120 in a refrigeration mode and a defrost mode, and the second LT evaporator 132 in a refrigeration mode or defrost mode, as described herein. The controller 148 includes a processor 154, memory 156, and a network interface circuit 158.

The processor 154 includes one or more processors operably coupled to the memory 156. The processor 154 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 156 and controls the operation of refrigeration system 100.

The processor 154 may be a programmable logic device, a microcontroller, a microprocessor, or any suitable combination of the preceding. The processor 154 is communicatively coupled to and in signal communication with the memory 156. The one or more processors are configured to process data and may be implemented in hardware or software. For example, the processor 154 may be 8-bit, 16-bit, 32-bit, 64-bit or of any other suitable architecture. The processor 15 may include an arithmetic logic unit (ALU) for performing arithmetic and logic operations, processor registers that supply operands to the ALU and store the results of ALU operations, and a control unit that fetches instructions from memory 156 and executes them by directing the coordinated operations of the ALU, registers, and other components. The processor 154 may include other hardware and software that operates to process information, control the refrigeration system 100, and perform any of the functions described herein (e.g., with respect to FIGS. 1-6). The processor 154 is not limited to a single processing device and may encompass multiple processing devices. Similarly, the controller 148 is not limited to a single controller but may encompass multiple controllers.

The memory 156 includes one or more disks, tape drives, or solid-state drives, and may be used as an over-flow data storage device, to store programs when such programs are selected for execution, and to store valve instructions 160, compressor instructions 162, and schedule instructions 164 and data that are read during program execution. The memory 156 may be volatile or non-volatile and may include ROM, RAM, ternary content-addressable memory (TCAM), dynamic random-access memory (DRAM), and static random-access memory (SRAM). The memory 156 is operable (or configured) to store information used by the controller 148 and/or any other logic and/or instructions for performing the function described in this disclosure.

The network interface circuit 158 is configured to communicate data and signals with other devices. For example, the network interface circuit 158 may be configured to communicate electrical signals with components of the refrigeration system 100 including valves 112, 114 of the flash tank 110, valve 118 of the MT evaporator, the MT compressor(s) 104, valves 122, 124, 126, 128, 130, 150 of the first LT evaporator 120, valves 134, 136, 138, 140, 142, 152 of the second LT evaporator 132, the LT compressor(s) 144, and valve 146 of the LT compressor(s) 144. The network interface circuit 158 may be configured to communicate with other devices and systems. The network interface circuit 158 may provide and/or receive, for example, compressor speed signals, compressor on/off signals, valve open/close signals, temperature signals, pressure signals, temperature setpoints, environmental conditions, and an operating mode status for the refrigeration system 100 and send electrical signals to the components of the refrigeration system 100. The network interface circuit 158 may include ports or terminals for establishing signal communications between the controller 148 and other devices. The network interface circuit 158 may be configured to enable wired and/or wireless communications. Suitable network interface circuits 158 include a WIFI interface, a local area network (LAN) interface, a wide area network (WAN) interface, a modem, a switch, or a router. The network interface circuit 158 may be configured to use any suitable type of communication protocol as would be appreciated by one of ordinary skill in the art.

Referring to FIG. 1, an example operation of the refrigeration system 100 is illustrated while operating in a normal refrigeration mode. In the normal refrigeration mode both the first LT evaporator 120 and the second LT evaporator 132 operate in a refrigeration mode. In some embodiments, the first LT evaporator 120 operates in a refrigeration mode when the first controllable valve 130 is open, the first check valve 128 is closed, the second controllable valve 122 is open, the fourth check valve 124 is closed, and the first LT expansion valve 126 reduces the pressure of the refrigerant received from the flash tank 110 before the refrigerant enters the first LT evaporator 120. In some embodiments, the second LT evaporator 132 operates in a refrigeration mode when the fourth controllable valve 142 is open, the second check valve 140 is closed, the third controllable valve 134 is open, the third check valve 136 is closed, and the second LT expansion valve reduces the pressure of the refrigerant received from the flash tank 110 before the refrigerant enters the second LT evaporator 132.

Referring to FIG. 2, at some point during operation of the refrigeration system 100, the controller 148 determines that the first LT evaporator 120 should operate in a defrost mode. For example, the controller 148 may determine based on scheduling instructions 164 from the memory 156 that the first LT evaporator 120 may be schedule for defrost (e.g., may be scheduled for defrost after a predetermined amount of time). After the controller 148 determines that the first LT evaporator 120 should operate in a defrost mode of operation, the controller 148 causes the refrigeration system 100 to be configured according to FIG. 2. As shown in FIG. 2, the first LT evaporator 120 operates in a defrost mode when the controller 148 causes the first controllable valve 130 to close, the third controllable valve 134 to close, and the first LT expansion valve 126 to open to increase a fraction of liquid refrigerant that is received by the first LT evaporator 120 during the defrost mode (FIG. 2) relative to a refrigeration mode (FIG. 1) of the LT evaporator 120. In some embodiments, the controller 148 causes the first LT expansion valve 126 to open fully (100% open). Opening the first LT expansion valve 126 floods the first LT evaporator 120 with liquid refrigerant from the flash tank 110 and defrosts the first LT evaporator 120. In some embodiments, the flash tank is operated at 50 bar and 60° C. While the first LT evaporator 120 operates in a defrost mode, the second LT evaporator continues to operate in a refrigeration mode and receives the refrigerant that is being used to defrost the first LT evaporator 120. For example, closing the first controllable valve 130 causes the first check valve 128 to open, and closing the third controllable valve 134 causes the third check valve 136 to open. In this way, the refrigerant exiting the first LT evaporator 120 in the defrost mode is received by the second LT evaporator 132, which operates in a refrigeration mode, as described herein. In some embodiments, the controller 148 is configured to determine that the defrost mode of the first low-temperature evaporator is complete, and after determining that the defrost mode is complete, cause the first low-temperature evaporator to operate in the refrigeration mode described in FIG. 1. The controller 148 may determine that the defrost mode is complete after running for a predetermined duration.

Referring to FIG. 3, at some point during operation of the refrigeration system 100, the controller 148 determines that the second LT evaporator 132 should operate in a defrost mode. For example, the controller 148 may determine based on scheduling instructions 164 from the memory 156 that the second LT evaporator 132 may be schedule for defrost (e.g., may be scheduled for defrost after a predetermined amount of time). After the controller 148 determines that the second LT evaporator 132 should operate in a defrost mode of operation, the controller 148 causes the refrigeration system 100 to be configured according to FIG. 3. As shown in FIG. 3, the second LT evaporator 132 operates in a defrost mode when the controller 148 causes the fourth controllable valve 142 to close, the second controllable valve 122 to close, and the second LT expansion valve 138 to open to increase a fraction of liquid refrigerant that is received by the second LT evaporator 132 during the defrost mode (FIG. 3) relative to a refrigeration mode (FIG. 1) of the second LT evaporator 132. During the defrost mode of the second LT evaporator, the first controllable valve 130 is open and the third controllable valve 134 is open. In some embodiments, the controller 148 causes the second LT expansion valve 138 to open fully (100% open). Opening the second LT expansion valve 138 floods the second LT evaporator 132 with liquid refrigerant from the flash tank 110 and defrosts the second LT evaporator 132. In some embodiments, the flash tank 110 is operated at 50 bar and 60° C. While the second LT evaporator 132 operates in a defrost mode, the first LT evaporator 120 continues to operate in a refrigeration mode and receives the refrigerant that is being used to defrost the second LT evaporator 132. For example, closing the fourth controllable valve 142 causes the second check valve 140 to open, and closing the second controllable valve 122 causes the fourth check valve 124 to open. In this way, the refrigerant exiting the second LT evaporator 132 in the defrost mode is received by the first LT evaporator 120, which operates in a refrigeration mode, as described herein.

Referring to FIG. 4, an alternative configuration for operating the first LT evaporator 120 in a defrost mode is illustrated with a first by-pass valve 150 and a second by-pass valve 152. In this alternative configuration, the controller 148 operates as described with respect to FIG. 2, but rather than opening the first LT expansion valve 126, the controller 148 is configured to cause the first LT evaporator 120 to operate in the defrost mode by opening the first by-pass valve 150 to direct refrigerant from the flash tank 110 to the first LT evaporator 120 through the first by-pass valve 150. In this way, the refrigerant by-passes the first LT expansion valve 126. The first by-pass valve 150 is configured to deliver the refrigerant from the flash tank 110 to the first LT evaporator 120 as predominately a liquid refrigerant. During the defrost mode, the second by-pass valve 152 is closed so that the refrigerant exiting the first LT evaporator 120 is passed through the second LT expansion valve 138 before the refrigerant is directed to the second LT evaporator 132.

Referring to FIG. 5, an alternative configuration for operating the second LT evaporator 132 in a defrost mode is illustrated with a first by-pass valve 150 and a second by-pass valve 152. In this alternative configuration, the controller 148 operates as described with respect to FIG. 3, but rather than opening the second LT expansion valve 138, the controller 148 is configured to cause the second LT evaporator 132 to operate in the defrost mode by opening second by-pass valve 152 to direct refrigerant from the flash tank 110 to the second LT evaporator 132 through the second by-pass valve 152. In this way, the refrigerant by-passes the second LT expansion valve 138. The second by-pass valve 152 is configured to deliver the refrigerant from the flash tank 110 to the first LT evaporator 120 as predominately a liquid refrigerant. During the defrost mode, the first by-pass valve 150 is closed so that the refrigerant exiting the second LT evaporator 132 is passed through the first LT expansion valve 126 before the refrigerant is directed to the first LT evaporator 120.

Example Method of Operation

Figure 6:
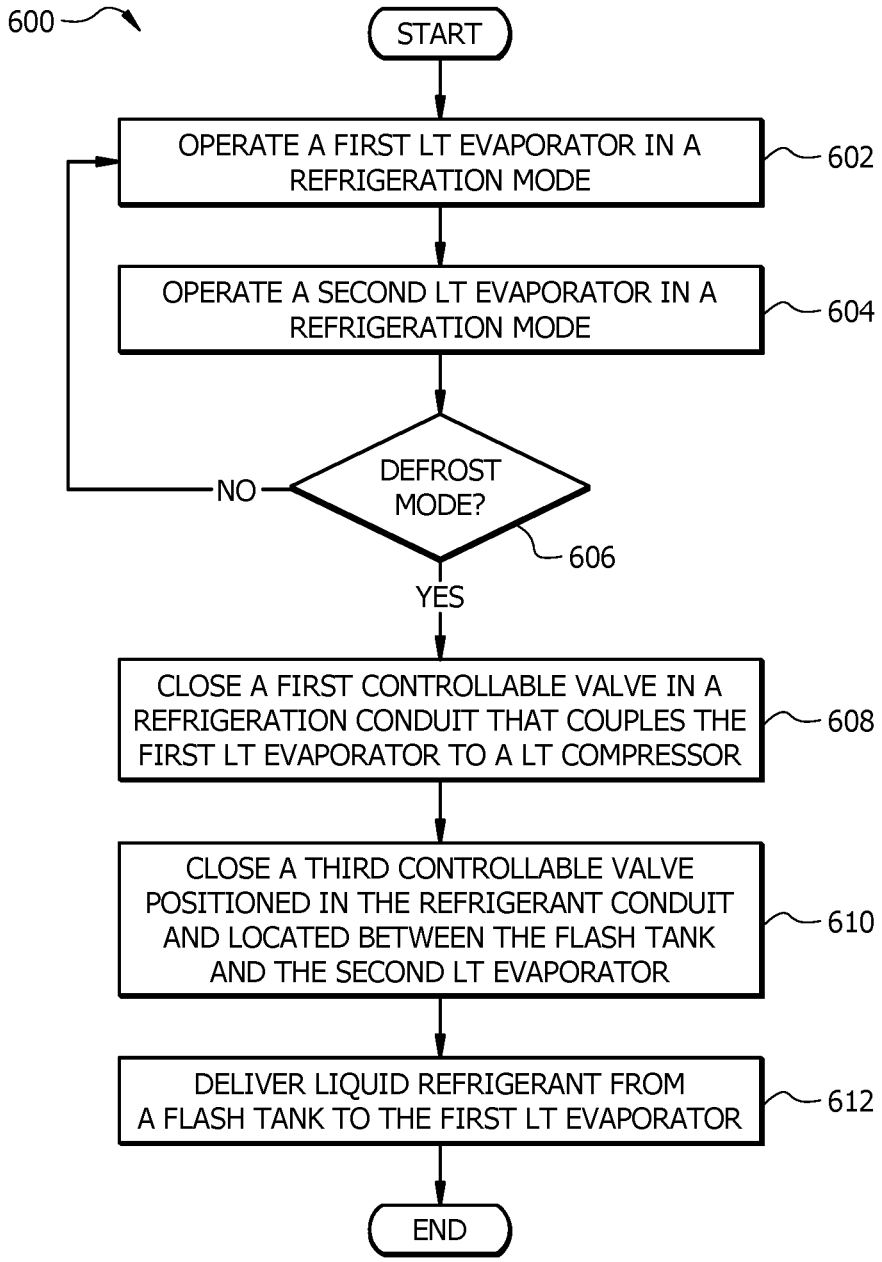
FIG. 6 is a flowchart of an example method of operating the refrigeration system of FIGS. 1 to 5.

FIG. 6 illustrates an example method 600 of operating the refrigeration system 100 described above with respect to FIGS. 1 to 5. The method may be implemented using the processor 154, the memory 156, and the network interface circuit 158 of the controller 148 of FIGS. 1 to 3. The method 600 can logically be described in two parts. The first part includes operations 602-604, which generally includes operating the first LT evaporator 120 in a refrigeration mode and operating the second LT evaporator 132 in a refrigeration mode. The second part includes operations 606-614, which generally includes determining that the first LT evaporator 120 should operate in a defrost mode, closing a first controllable valve 130 in a refrigerant conduit 102 that couples the first LT evaporator 120 to the LT compressor(s) 144, delivering liquid refrigerant from the flash tank 110 to the first LT evaporator 120, and closing a third controllable valve 134 positioned in the refrigerant conduit 102 and located between the flash tank and the second LT evaporator to cause the refrigerant exiting the first LT evaporator 120 to mix with refrigerant entering the second LT evaporator 132.

In operation, the method 600 may begin at operation 602 where the first LT evaporator 120 operates in a refrigeration mode, and operation 604 where the second LT evaporator 132 operates in a refrigeration mode. The first LT evaporator 120 operates in a refrigeration mode when the first controllable valve 130 is open, the first check valve 128 is closed, the second controllable valve 122 is open, the fourth check valve 124 is closed, and the first LT expansion valve 126 reduces the pressure of the refrigerant received from the flash tank 110 before the refrigerant enters the first LT evaporator 120. In some embodiments, the second LT evaporator 132 operates in a refrigeration mode when the fourth controllable valve 142 is open, the second check valve 140 is closed, the third controllable valve 134 is open, the third check valve 136 is closed, and the second LT expansion valve reduces the pressure of the refrigerant received from the flash tank 110 before the refrigerant enters the second LT evaporator 132.

At operation 606, the controller 148 determines that the first LT evaporator 120 should operate in a defrost mode, which may be based on scheduling instructions 164 in the memory 156, as described above. If the controller 148 determines that the first LT evaporator 120 is not scheduled for a defrost mode, then the method returns to operation 602, where the first LT evaporator 120 continues to operate in a refrigeration mode. If the controller 148 determines that the first LT evaporator 120 is scheduled for a defrost mode, the method 600 continues to operation 608.

At operation 608, the controller 148 is configured to operate the first LT evaporator 120 in a defrost mode by closing a first controllable valve 130 in the refrigerant conduit 102 that couples the first LT evaporator 120 to the LT compressor(s) 144. At operation 610, the controller 148 is configured to close a third controllable valve 134. Closing the first controllable valve 130 causes the first check valve 128 to open, and closing the third controllable valve 134 causes the third check valve 136 to open. In this way, the refrigerant exiting the first LT evaporator 120 in the defrost mode is received by the second LT evaporator 132, which operates in a refrigeration mode, as described herein.

At operation 612, the method 600 includes delivering liquid refrigerant from the flash tank 110 to the first LT evaporator 120. This can be done in two ways. In a first arrangement, the controller 148 may open the first LT expansion valve 126 to increase a fraction of liquid refrigerant that is received by the first LT evaporator 120 during the defrost mode (FIG. 2) relative to a refrigeration mode (FIG. 1) of the LT evaporator 120. In some embodiments, the controller 148 causes the first LT expansion valve 126 to open fully (100% open). Opening the first LT expansion valve 126 floods the first LT evaporator 120 with liquid refrigerant from the flash tank 110 and defrosts the first LT evaporator 120. In an alternative arrangement, the controller 148 may deliver liquid refrigerant to the LT evaporator 120 in a defrost mode by opening the first by-pass valve 150 to direct refrigerant from the flash tank 110 to the first LT evaporator 120 through the first by-pass valve 150. In this way, the refrigerant by-passes the first LT expansion valve 126. The first by-pass valve 150 is configured to deliver the refrigerant from the flash tank 110 to the first LT evaporator 120 as predominately a liquid refrigerant. During the defrost mode, the second by-pass valve 152 is closed so that the refrigerant exiting the first LT evaporator 120 is passed through the second LT expansion valve 138 before the refrigerant is directed to the second LT evaporator 132. Once the defrost has operate for a duration, the method 600 may end.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system, comprising:

a flash tank configured to receive refrigerant from a gas cooler through a refrigerant conduit, the flash tank configured to store at least a portion of the refrigerant received from the gas cooler;

a first low-temperature evaporator located downstream of the flash tank and configured to receive the refrigerant from the flash tank through the refrigerant conduit;

a second low-temperature evaporator located downstream of the flash tank and configured to receive the refrigerant from the flash tank through the refrigerant conduit;

a low-temperature compressor located downstream of the first low-temperature evaporator and the second low-temperature evaporator, the low-temperature compressor configured to receive the refrigerant from the first low-temperature evaporator and the second low-temperature evaporator through the refrigerant conduit;

a first controllable valve positioned in the refrigerant conduit and downstream from the first low-temperature evaporator, the first controllable valve configured to control refrigerant from the first low-temperature evaporator and direct a flow of the controlled refrigerant to: (i) the low-temperature compressor when the first controllable valve is configured in an open position; and (ii) the second low-temperature evaporator when the first controllable valve is configured in a closed position;

a first expansion valve positioned in the refrigerant conduit and located between the flash tank and the first low-temperature evaporator; and a second expansion valve positioned in the refrigerant conduit and located between the flash tank and the second low-temperature evaporator; and a controller communicatively coupled to the first controllable valve, wherein the controller is configured to:

cause the first low-temperature evaporator to operate in a defrost mode by closing the first controllable valve to direct the refrigerant exiting the first low-temperature evaporator to be received by the second low-temperature evaporator, wherein the controller is further configured to cause the first low-temperature evaporator to operate in the defrost mode by opening the first expansion valve to increase a fraction of liquid refrigerant that is received by the first low-temperature evaporator during the defrost mode relative to a refrigeration mode of the first low-temperature evaporator, and wherein the first controllable valve in the defrost mode directs the refrigerant exiting the first low-temperature evaporator to the second expansion valve before the refrigerant is directed to the second low-temperature evaporator.

2. The refrigeration system of claim 1 further comprising:

the first expansion valve positioned in the refrigerant conduit and located between the flash tank and the first low-temperature evaporator;

a first by-pass valve positioned in the refrigerant conduit and located between the flash tank and the first low-temperature evaporator, wherein when the first by-pass valve is in a closed position the refrigerant flows from the flash tank to the first low-temperature evaporator through the first expansion valve, and when the first by-pass valve is in an open position the refrigerant flows from the flash tank to the first low-temperature evaporator through the first by-pass valve;

the second expansion valve positioned in the refrigerant conduit and located between the flash tank and the second low-temperature evaporator; and a second by-pass valve positioned in the refrigerant conduit and located between the flash tank and the second low-temperature evaporator, wherein when the second by-pass valve is in a closed position the refrigerant flows from the flash tank to the second low-temperature evaporator through the first expansion valve, and when the second by-pass valve is in an open position the refrigerant flows from the flash tank to the second low-temperature evaporator through the second by-pass valve;

wherein the controller is further configured to cause the first low-temperature evaporator to operate in the defrost mode by opening the first by-pass valve to direct refrigerant from the flash tank to the first low-temperature evaporator through the first by-pass valve and closing the second by-pass valve to direct the refrigerant exiting the first low-temperature evaporator to the second expansion valve before the refrigerant is directed to the second low-temperature evaporator.

3. The refrigeration system of claim 1 further comprising:

a second controllable valve positioned in the refrigerant conduit and located between the flash tank and the first low-temperature evaporator, wherein when the first low-temperature evaporator is operating in the refrigeration mode the second controllable valve is open;

a third controllable valve positioned in the refrigerant conduit and located between the flash tank and the second low-temperature evaporator, wherein when the second low-temperature evaporator is operating in the refrigeration mode the third controllable valve is open; and a fourth controllable valve positioned in the refrigerant conduit and located downstream from the second low-temperature evaporator, the fourth controllable valve configured to receive refrigerant from the second low-temperature evaporator and direct the flow of refrigerant to: (i) the low-temperature compressor when the fourth controllable valve is configured in an open position, and (ii) the first low-temperature evaporator when the fourth controllable valve is configured in a closed position;

wherein the controller is further configured to cause the first low-temperature evaporator to operate in the defrost mode by causing the third controllable valve to close.

4. The refrigeration system of claim 3, wherein the controller is configured to cause the second low-temperature evaporator to operate in a defrost mode by opening the first controllable valve, closing the second controllable valve, opening the third controllable valve, and closing the fourth controllable valve.

5. The refrigeration system of claim 3 further comprising:

a first check valve positioned in a portion of the refrigerant conduit that directs the refrigerant exiting the first low-temperature evaporator to mix with the refrigerant entering the second low-temperature evaporator, wherein when the first low-temperature evaporator is operating in the defrost mode the first check valve is configured to allow the refrigerant to flow from the first low-temperature evaporator to the second low-temperature evaporator; and a second check valve positioned in a portion of the refrigerant conduit that directs the refrigerant exiting the second low-temperature evaporator to mix with the refrigerant entering the first low-temperature evaporator, wherein when the first low-temperature evaporator is operating in the defrost mode the second check valve is configured to restrict the refrigerant flowing from the second low-temperature evaporator to the first low-temperature evaporator.

6. The refrigeration system of claim 1, wherein the controller is further configured to determine that the defrost mode of the first low-temperature evaporator is complete, and after determining that the defrost mode is complete, cause the first low-temperature evaporator to operate in the refrigeration mode.

7. A method of operating a refrigeration system, the method comprising:

operating a first low-temperature evaporator in a refrigeration mode, wherein the first low-temperature evaporator receives refrigerant from a flash tank;

operating a second low-temperature evaporator in the refrigeration mode, wherein the first second low-temperature evaporator receives refrigerant from the flash tank; and causing the first low-temperature evaporator to operate in a defrost mode by:

closing a first controllable valve in a refrigerant conduit that couples the first low-temperature evaporator to a low-temperature compressor of the refrigeration system; and directing the refrigerant exiting the first low-temperature evaporator to be received by the second low-temperature evaporator, wherein operating the first low-temperature evaporator in the defrost mode further comprises:

opening a first expansion valve positioned in the refrigerant conduit, wherein the first expansion valve is located between the flash tank and the first low-temperature evaporator, and wherein opening the first expansion valve increases a fraction of liquid refrigerant that is received by the first low-temperature evaporator during the defrost mode relative to the refrigeration mode of the first low-temperature evaporator; and directing the refrigerant exiting the first low-temperature evaporator to a second expansion valve positioned between the flash tank and the second low-temperature evaporator.

8. The method of claim 7, wherein operating the first low-temperature evaporator in the defrost mode further comprises:

opening a first by-pass valve positioned in the refrigerant conduit, wherein the first by-pass valve is located between the flash tank and the first low-temperature evaporator, and when the first by-pass valve is open the refrigerant flows around the first expansion valve located between the flash tank and the first low-temperature evaporator and through the first by-pass valve; and closing a second by-pass valve positioned in the refrigerant conduit, wherein the second by-pass valve is located between the flash tank and the second low-temperature evaporator, and when the second by-pass valve is closed the refrigerant flows through the second expansion valve located between the flash tank and the second low-temperature evaporator.

9. The method of claim 7, wherein operating the first low-temperature evaporator in the defrost mode further comprises:

passing the refrigerant through a second controllable valve positioned in the refrigerant conduit located between the flash tank and the first low-temperature evaporator;

closing a third controllable valve positioned in the refrigerant conduit and located between the flash tank and the second low-temperature evaporator; and passing the refrigerant through a fourth controllable valve positioned in the refrigerant conduit and located downstream from the second low-temperature evaporator, and when the fourth controllable valve is open the refrigerant is directed to the first low-temperature evaporator.

10. The method of claim 9, further comprising:

causing the second low-temperature evaporator to operate in a defrost mode by opening the first controllable valve, closing the second controllable valve, opening the third controllable valve, and closing the fourth controllable valve.

11. The method of claim 9, wherein operating the first low-temperature evaporator in the defrost mode further comprises:

passing the refrigerant exiting the first low-temperature evaporator through a first check valve positioned in the refrigerant conduit, wherein the refrigerant passing through the first check valve is directed to mix with the refrigerant entering the second low-temperature evaporator; and restricting the refrigerant exiting the second low-temperature evaporator from flowing to the first low-temperature evaporator using a second check valve positioned in a portion of the refrigerant conduit that directs the refrigerant exiting the second low-temperature evaporator to mix with the refrigerant entering the first low-temperature evaporator.

12. The method of claim 7 further comprising:

determining that the defrost mode of the first low-temperature evaporator is complete; and causing the first low-temperature evaporator to operate in the refrigeration mode.

13. A controller of a refrigeration system, the controller comprising:

a network interface circuit communicatively coupled to a first controllable valve positioned in a refrigerant conduit and downstream from a first low-temperature evaporator, the first controllable valve configured control refrigerant from the first low-temperature evaporator and direct a flow of the controlled refrigerant to: (i) a low-temperature compressor when the first controllable valve is configured in an open position; and (ii) a second low-temperature evaporator when the first controllable valve is configured in a closed position; and a processor operably coupled to the network interface circuit and configured to:

cause the first low-temperature evaporator to operate in a defrost mode by closing the first controllable valve to direct the refrigerant exiting the first low-temperature evaporator to be received by the second low-temperature evaporator, wherein the controller is further configured to cause the first low-temperature evaporator to operate in the defrost mode by:

opening a first expansion valve positioned in the refrigerant conduit, wherein the first expansion valve is located between a flash tank and the first low-temperature evaporator, and wherein opening the first expansion valve increases a fraction of liquid refrigerant that is received by the first low-temperature evaporator during the defrost mode relative to a refrigeration mode of the first low-temperature evaporator; and directing the refrigerant exiting the first low-temperature evaporator to a second expansion valve positioned between the flash tank and the second low-temperature evaporator.

14. The controller of claim 13, wherein the controller is further configured to cause the first low-temperature evaporator to operate in the defrost mode by:

opening a first by-pass valve positioned in the refrigerant conduit, wherein the first by-pass valve is located between the flash tank and the first low-temperature evaporator, and when the first by-pass valve is open the refrigerant flows around the first expansion valve located between the flash tank and the first low-temperature evaporator and through the first by-pass valve; and closing a second by-pass valve positioned in the refrigerant conduit, wherein the second by-pass valve is located between the flash tank and the second low-temperature evaporator, and when the second by-pass valve is closed the refrigerant flows through the second expansion valve located between the flash tank and the second low-temperature evaporator.

15. The controller of claim 13, wherein the controller is further configured to cause the first low-temperature evaporator to operate in the defrost mode by:

passing the refrigerant through a second controllable valve positioned in the refrigerant conduit located between a flash tank and the first low-temperature evaporator;

closing a third controllable valve positioned in the refrigerant conduit and located between the flash tank and the second low-temperature evaporator; and passing the refrigerant through a fourth controllable valve positioned in the refrigerant conduit and located downstream from the second low-temperature evaporator, and when the fourth controllable valve is open the refrigerant is directed to the first low-temperature evaporator.

16. The controller of claim 15, wherein the controller is further configured to cause the second low-temperature evaporator to operate in a defrost mode by opening the first controllable valve, closing the second controllable valve, opening the third controllable valve, and closing the fourth controllable valve.

17. The controller of claim 13, further comprising:

determining that the defrost mode of the first low-temperature evaporator is complete; and causing the first low-temperature evaporator to operate in the refrigeration mode.

* * * * *